US008516612B2

(12) United States Patent
Lynn

(10) Patent No.: US 8,516,612 B2
(45) Date of Patent: Aug. 27, 2013

(54) CULINARY FINGER GUARD AND ASSOCIATED METHOD

(76) Inventor: Donald Lynn, Palm Beach Gardens, FL (US)

( * ) Notice: Subject to any disclaimer, the term of this patent is extended or adjusted under 35 U.S.C. 154(b) by 175 days.

(21) Appl. No.: 12/965,764

(22) Filed: Dec. 10, 2010

(65) Prior Publication Data

US 2012/0144545 A1 Jun. 14, 2012

(51) Int. Cl.
*A41D 13/08* (2006.01)

(52) U.S. Cl.
USPC ..... 2/21

(58) Field of Classification Search
USPC ..... 2/16, 21, 163, 160, 161.1, 22, 159, 2/161; 602/22; 128/878, 879, 880
See application file for complete search history.

(56) References Cited

U.S. PATENT DOCUMENTS

| | | | | |
|---|---|---|---|---|
| 1,337,957 | A | 4/1920 | Rasmussen | |
| 1,388,618 | A * | 8/1921 | Stein et al. | 2/21 |
| 1,755,014 | A | 4/1930 | Morrison | |
| 1,951,190 | A * | 3/1934 | Gambee | 2/21 |
| 2,070,506 | A | 2/1937 | Bevill | |
| 2,460,155 | A | 1/1949 | Talarico | |
| 2,925,605 | A | 2/1960 | Wheeler | |
| 3,728,736 | A | 4/1973 | Pugh | |
| 4,143,653 | A * | 3/1979 | Wichman | 602/22 |
| 4,507,804 | A | 4/1985 | Consigny | |
| 4,829,988 | A * | 5/1989 | Caminiti | 602/22 |
| 5,363,508 | A | 11/1994 | Kim | |
| 5,450,626 | A | 9/1995 | Sorrels | |
| 5,609,165 | A | 3/1997 | Lambert | |
| 5,711,027 | A | 1/1998 | Katz et al. | |
| D415,321 | S | 10/1999 | Silvey | |
| 6,145,128 | A | 11/2000 | Suzuki | |
| 6,665,874 | B2 | 12/2003 | Stolf | |
| 7,275,268 | B2 | 10/2007 | Gait | |
| 7,296,300 | B2 | 11/2007 | Votolato | |
| 7,574,748 | B2 | 8/2009 | Fisher et al. | |
| 2005/0005338 | A1 | 1/2005 | Lewis | |
| 2006/0253952 | A1 | 11/2006 | Caudillo | |
| 2008/0052799 | A1 | 3/2008 | Yoo | |

* cited by examiner

*Primary Examiner* — Khoa Huynh
*Assistant Examiner* — Anna Kinsaul

(57) ABSTRACT

A finger guard includes a first segment, a middle segment, a plurality of compound segments and an end segment. The first segment preferably has a unitary body with the plurality of compound segments spaced from such a first segment. The middle segment has a unitary body and may be intermediately disposed between the first and compound segments respectively. The end segment may be positioned at a distal end of the compound segments. An underlayment having a flexible body may further be attached to each of the first, middle, compound and end segments respectively. Each of the first, middle, compound and end segments may be independently displaced along mutually exclusive paths when the underlayment is displaced. The finger guard is adapted to the movements of the user finger when guiding the food to be cut and provides speed and accuracy for food cutting operations in a comfortable, safe and non-restrictive manner.

20 Claims, 3 Drawing Sheets

CULINARY FINGER GUARD AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to food preparation implements and, more particularly, to a culinary finger guard for providing users with an easy and convenient means of protecting their forefinger while cutting and slicing food with a knife.

2. Prior Art

Food preparation is an everyday activity for the single individual or family whenever they are at home and even more so for professionals who have made cooking their livelihood. The first steps in the process of food preparation always involve cutting and slicing with a sharp knife. This is necessary because a blunt knife may do more harm than good due to the knife's propensity to slide off the raw of tough food and onto the fingers of the inexperienced user. As such, finger and hand protection have long been used to protect the user's fingers from being accidentally cut especially when slicing, dicing and chopping vegetables and meat. Such protections are necessary not only because of the injury that may be caused to the user's hand but also because of the probably of food contamination when blood is drawn. While these finger and hand protection gears such as gloves and thimbles are useful, however they are inadequate to protect as well as to help the user to do an efficient job of cutting in the kitchen. For example, thimbles protect only the tips of the user's fingers while gloves are clumsy and bulky and may get in the way of the user's hands in getting a proper food cutting job done.

There are conventional finger guards available in the market today to protect users' fingers in the kitchen, but most of these finger guards are too rigid and inflexible, and do not protect the forefingers adequately.

Accordingly, a need remains for a culinary finger guard to overcome the above-noted shortcomings. The present invention satisfies such a need by providing a culinary finger guard that is convenient and easy to use, lightweight yet durable in design, versatile in its applications, and designed for protecting users' forefingers from being cut while cutting and slicing food with a knife.

BRIEF SUMMARY OF THE INVENTION

In view of the foregoing background, it is therefore an object of the present invention to provide an finger guard for protecting a user finger from being cut by a cutting implement while preparing food. These and other objects, features, and advantages of the invention are provided by a finger guard.

The finger guard may include a first segment, a middle segment, a plurality of compound segments and an end segment. The first segment preferably has a unitary body with the plurality of compound segments spaced from such a first segment. The middle segment preferably has a unitary body and may be intermediately disposed between the first and compound segments respectively. The end segment may be positioned at a distal end of the compound segments.

An underlayment preferably having a flexible body may further be attached to each of the first, middle, compound and end segments respectively. Each of the first, middle, compound and end segments may be independently displaced along mutually exclusive paths when the underlayment is displaced. Such an arrangement provides the unexpected and unpredictable advantage of providing a finger guard that is adapted to the movements of the user finger when guiding the food to be cut. The finger guard is thus crucial in providing speed and accuracy for food cutting operations in a comfortable, safe and non-restrictive manner.

The finger guard may further include a first obliquely angled gap located between adjoining edges of the first and middle segments respectively. A second obliquely angled gap may be located between adjoining edges of the middle segment and an adjacent one of the compound segments respectively. A plurality of third obliquely angled gaps may be located between adjoining edges of remaining ones of the compound segments respectively. Such an arrangement provides the unexpected and unpredictable advantage of allowing the first, middle, compound and end segments to respectively and freely articulate along a unique arcuate path in sync with the stretching and curling of the user finger without interfering with each other.

Selected ones of the compound segments may include a leading edge and a trailing edge respectively, such that the leading edge is thicker than the trailing edge. In this way, the trailing edge may overlap a juxtaposed one of the leading edge such that the leading edge extends beyond the juxtaposed trailing edge. Such an arrangement provides an unexpected and unpredictable advantage of ensuring that the obliquely angled gaps are not exposed when the user finger is curled for cutting operations as well as further providing an overlapping but smooth arrangement of the compound segments against each.

The finger guard may further include a plurality of first obliquely angled grooves formed at opposed longitudinal edges of the first and middle segments respectively and a plurality of second obliquely angled grooves formed at opposed longitudinal edges of selected ones of the compound segments respectively. Such an arrangement provides an unexpected and unpredictable advantage of allowing for any lateral movements of the segments against each other when the user finger is being held against the cutting implement during cutting operations.

The compound segments may be configured along a curvilinear path when the underlayment is at a non-tensioned equilibrium position. The underlayment may further be formed from deformably resilient material such that it may be returned to a non-tensioned curvilinear position after being released from a tensioned linear position. In this way, the compound segments may automatically return to its curvilinear equilibrium position thus advantageously allowing the user finger to be unrestricted when in a relaxed positioned in between cutting operations.

The disclosure may include a method of utilizing a finger guard for protecting a user finger from being cut by a cutting implement while preparing food. Such a method may include the chronological steps of: providing a first segment preferably having a unitary body; providing and spacing a plurality of compound segments from the first segment; providing a middle segment preferably having a unitary body; intermediately disposing the middle segment between the first and compound segments respectively; providing and positioning an end segment at a distal end of the compound segments; providing an underlayment preferably having a flexible body; attaching the underlayment to each of the first, middle, compound and end segments respectively; and independently displacing each of the first, middle, compound and end segments along mutually exclusive paths by displacing the underlayment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
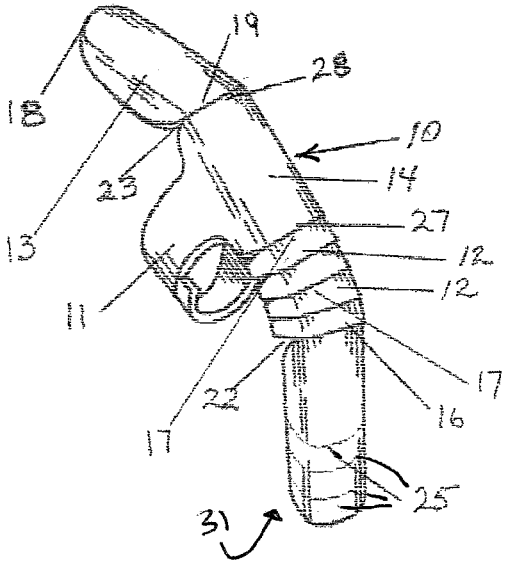
FIG. 1 is a perspective view showing a culinary finger guard, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of finger guard and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description. The terms "forefinger" and "finger" are used interchangeably throughout the disclosure.

The finger guard of this invention is referred to generally in FIGS. 1-6 and is intended to provide a culinary finger guard for protecting a user's finger during cutting/slicing operations. It should be understood that the present invention may be used to protect more than one user finger from being cut while cutting/slicing food with a variety of cutting implements, and should not be limited to protecting only the forefinger.

Referring generally to FIGS. 1-6, the finger guard 10 may include a first segment 13, a middle segment 14, a plurality of compound segments 12 and an end segment 31. The first segment 13 preferably has a unitary body with the plurality of compound segments 12 spaced from such a first segment 13. Similarly, the middle segment 14 preferably has a unitary body and may be intermediately disposed between the first and compound segments 13, 12, respectively. The end segment 31 may be positioned at a distal end of the compound segments 12.

Notably, an underlayment 15 preferably has a flexible body attached to each of the first, middle, compound and end segments 13, 14, 12, 31, respectively. Each of the first, middle, compound and end segments 13, 14, 12, 31 may be independently displaced along mutually exclusive paths 101, 102, 91, 90, respectively, when the underlayment 15 is displaced. Such a structural arrangement provides the unexpected and unpredictable advantage of providing a finger guard 10 that effectively and resiliently conforms to the movements (shape) of the user finger 13 when cutting/slicing food. The finger guard 10 thereby enables a user to quickly cut/slice food without undesirably cutting his/her finger(s).

Figure 6:
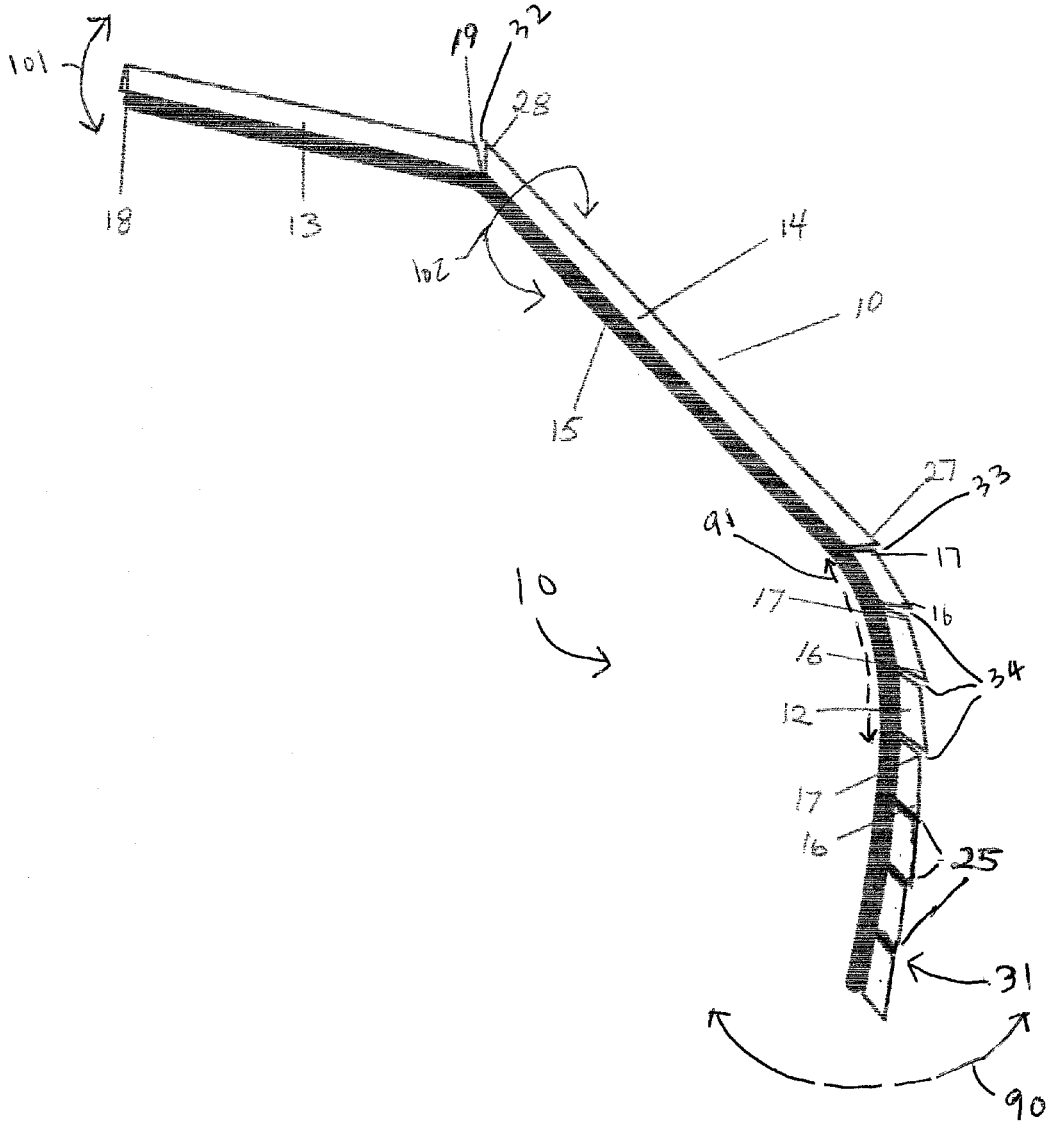
FIG. 6 is a cross-sectional view showing the interrelationship between the first, middle, compound and end segments, respectively.

As perhaps best shown in FIG. 6, the finger guard 10 may further include a first obliquely angled gap 32 located between adjoining edges of the first and middle segments 13, 14, respectively. A second obliquely angled gap 33 may be located between adjoining edges of the middle segment 14 and an adjacent one of the compound segments 12, respectively. A plurality of third obliquely angled gaps 34 may be located between adjoining edges of remaining ones of the compound segments 12, respectively. Such a structural arrangement provides the unexpected and unpredictable advantage of allowing the first, middle, compound and end segments 13, 14, 12, 31 to freely articulate along respective unique arcuate paths 101, 102, 91, 90 in a manner that synchronously conforms to stretching and curling the user finger 13.

Referring to FIGS. 3-6, selected ones of the compound segments 12 may include a leading edge 16 and a trailing edge 17, respectively, wherein the leading edge 16 is thicker than the trailing edge 17. In this way, the trailing edge 17 advantageously is overlapped by a juxtaposed leading edge 16 such that the leading edge 16 extends beyond the juxtaposed trailing edge 17. Such a structural arrangement provides an unexpected and unpredictable advantage of ensuring the obliquely angled gaps 34 are not exposed to the cutting implement (knife) when the user finger is curled during cutting operations. The overlapping pattern also guides the knife along an outer surface of the compound segments 12 and thereby prevents the knife from entering gaps 34.

Referring to FIGS. 1-5, the finger guard 10 may further include a plurality of first obliquely angled grooves 23 formed at opposed longitudinal edges of the first and middle segments 13, 14, respectively. A plurality of second obliquely angled grooves 22 are formed at opposed longitudinal edges of selected ones of the compound segments 12, respectively. Such grooves 23, 22 provide an unexpected and unpredictable advantage of allowing the finger guard 10 to be formed with a curvilinear shape and thereby resiliently return to such a curvilinear shape after being tensioned to a linear shape.

Referring in more detail to FIG. 6, the compound segments 12 may be configured along the curvilinear path 91 when the underlayment 15 is at a non-tensioned equilibrium position. Such an underlayment 15 may be formed from deformably resilient material such that it may be returned to a non-tensioned curvilinear position after being released from a tensioned linear position. In this way, the compound segments 12 automatically return to the curvilinear equilibrium position when the user relaxes his/her finger during cutting/slicing operations.

As a non-limiting example, the present disclosure may further include a method of utilizing a finger guard 10 for protecting a user finger 13 from being cut by a cutting implement while preparing food. Such a method may include the chronological steps of: providing a first segment 13 preferably having a unitary body; providing and spacing a plurality of compound segments 12 from the first segment 13; providing a middle segment 14 preferably having a unitary body; intermediately disposing the middle segment 14 between the first and compound segments 13, 12, respectively; providing and positioning an end segment 31 at a distal end of the compound segments 12; providing an underlayment 15 preferably having a flexible body; attaching the underlayment 15 to each of the first, middle, compound and end segments 13, 14, 12, 31, respectively; and independently displacing each of the first, middle, compound and end segments 13, 14, 12, 31 along mutually exclusive paths by displacing the underlayment 15 (bending and straightening the user finger).

Referring to a non-limiting example, shown in FIGS. 1-6, the culinary finger guard 10 preferably includes a first segment 13, a middle segment 14, a plurality of compound segments 12, an end segment 31 and a flexible underlayment 15. The first segment 13 may be longer than the compound segments 12 and preferably has a leading edge 18 which is thicker than its trailing edge 19. The middle segment 14 may serve as intermediary coupling to the first and compound segments 13, 12, respectively. Such middle segment 14 preferably and includes a split, expandable ring holder 11. In this way, the user may wear the guard 10 on the forefinger in such a manner that the middle segment 14 lays medially between first and second knuckles of the user forefinger. For example, the ring holder 11 may grip a middle phalange 29 of a forefinger.

The middle segment 14 may be thicker than trailing edge 19 of the first segment 13 and may further have the same thickness throughout from edge portion 27 to edge portion 28. As perhaps best shown in FIG. 6, edge portions 27 and 28 have oblique angles extending away from a center of middle segment 14. Such oblique angles create a diverging gap between adjoining edges 19 and 17, respectively. In this manner, the middle segment 14 freely deforms about a pair of opposed pivot axes defined at an edge portions 19, 28 and 27, 17, respectively. With the use of the flexible underlayment 15, the offset positions of the first and middle segments 12, 14 are easily adjusted according to a contour of the user's forefinger. Likewise, as perhaps best shown in FIG. 3, when the user forefinger is returned to a linear position, the first and middle segments 12, 14 become axially aligned along a linear path.

Referring back to FIG. 6, the plurality of compound segments 12 may include a plurality of leading edges 16 and trailing edges 17 wherein the leading edges 16 are thicker than the trailing edges 17 to provide an overlapping configuration. In particular, when the forefinger is bent, each leading edge 16 extends beyond a juxtaposed trailing edge 17 and thereby guides a knife's travel path along a curvilinear outer surface of the compound segments 12. Such a configuration prevents the knife from passing into the gaps 33 between juxtaposed leading and trailing edges 16, 17, thereby protecting the user forefinger. In a similar manner, edge portion 27 may further be thicker than the first trailing edge 17 of compound segments 12.

Figure 2:
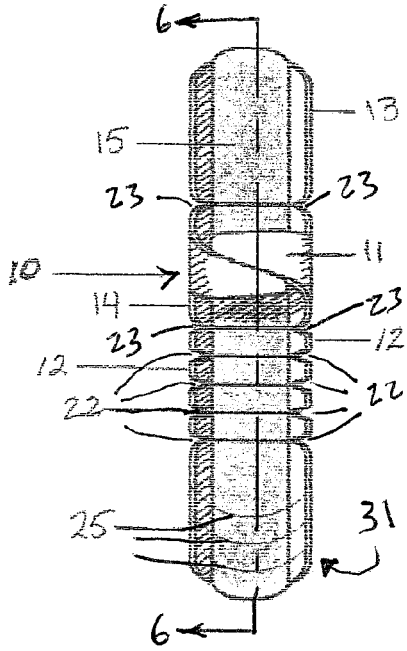
FIG. 2 is a bottom plan view of the finger guard shown in FIG. 1.
Figure 3:
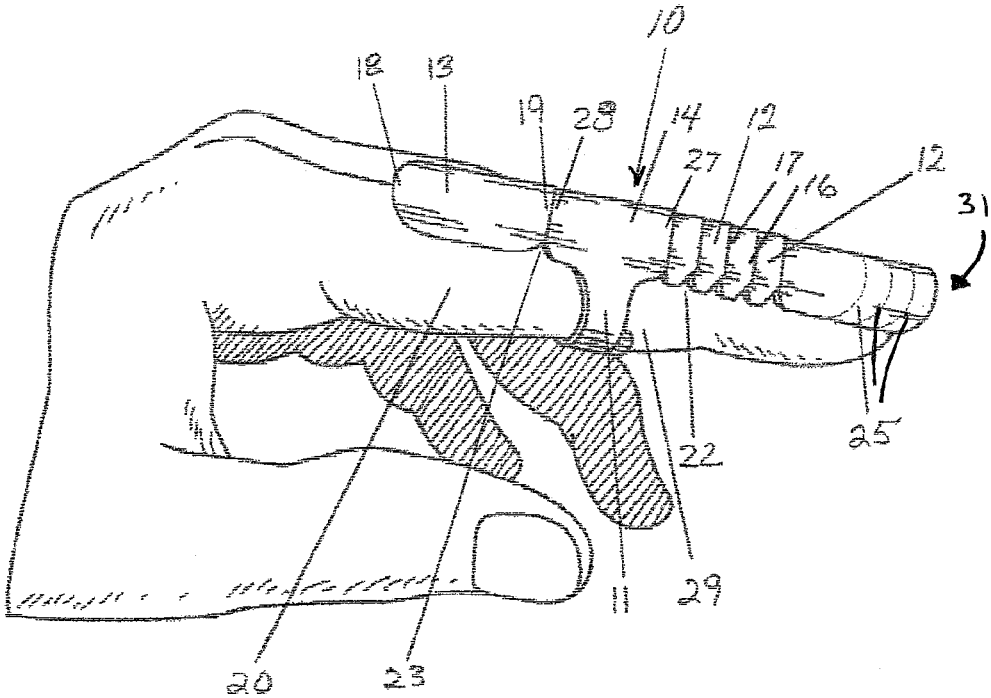
FIG. 3 is perspective view showing the finger guard positioned on a user finger and straightened to a tensioned linear position.

As perhaps best shown in FIGS. 1 and 2, a plurality of spaced grooves 22, 23 are formed at opposed longitudinal edges of sections 12 and 13, 14, respectively. Such grooves 22, 23 enable resilient flexibility of the guard 10 as the user bends and straightens his/her finger. The grooves 22, 23 are cut at oblique angles thereby allowing unobstructed resilient movement during use. Notably, filler material is preferably nested within grooves 22, 23 during manufacture of guard 10. Such filler material permits guard 10 to maintain a curvilinear shape at equilibrium (when no external forces are exerted on the guard 10). Thus, the guard 10 is formed with a curvilinear shape and retains such a curvilinear shape when the user is resting their finger at a relaxed position or when guard 10 has been removed from the user finger. The guard 10 is subsequently straightened as the user straightens his/her finger. The straightened position of guard 10 is its tensioned position, thereby automatically (resiliently) returning to its curvilinear equilibrium position when the user relaxes his/her finger.

Figure 5:
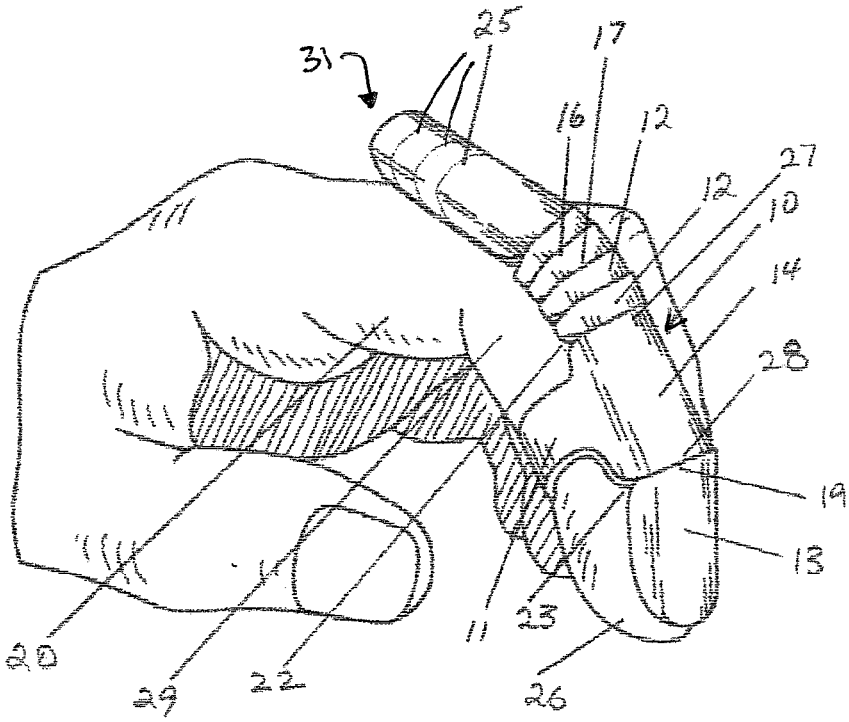
FIG. 5 is a perspective view showing the end segment of the finger guard positioned at a distal end of the user finger.

As perhaps best shown in FIG. 5, in one embodiment, end segment 31 may be positioned at a distal end 26 of the user's forefinger.

Figure 4:
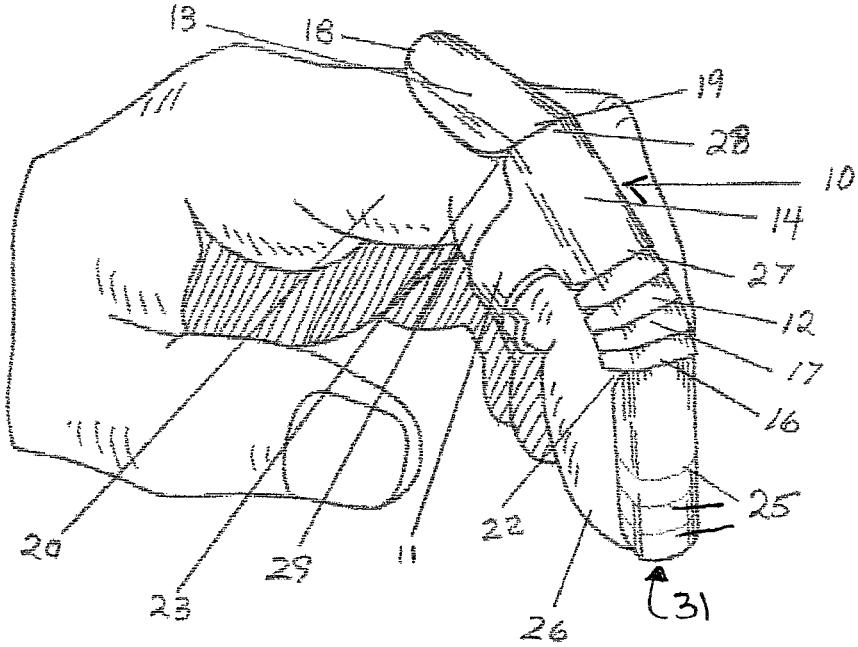
FIG. 4 is a perspective view of showing finger guard positioned on a user finger and relaxed to a non-tensioned (equilibrium) curvilinear position.

As perhaps best shown in FIG. 4, in another embodiment, end segment 13 may be positioned at a distal end 26 of the user's forefinger.

As noted above, a flexible underlayment 15 may be formed from a deformably resilient material and thereby maintain a curvilinear shape of the guard 10. As a non-limiting example, underlayment 15 may act as a "hinge" for the first segment 13 and middle segment 14; the middle segment 14 and compound segment 12 and between all the compound segments 12. The flexible underlayment 15 may be manufactured from plastic, rubber or a combination of materials including silicone, KEVLAR® (para-aramid synthetic fiber), or other polyvinylchloride materials. Of course, the thickness and resilient characteristics of the underlayment 15 may be modified to suit the user's needs.

Referring back to FIG. 6, the first segment 13 and middle segment 14 and the plurality of compound segments 12 are shown as including the obliquely angled gaps 32, 33 between adjoining end portions thereof, respectively. Such obliquely angled gaps 32, 33 advantageously permit each segment to freely articulate along a unique arcuate path without affecting a stationary position of other segments.

Referring to FIGS. 1-4 and 6, segment 31 may include a plurality of spaced perforations that define lines of weakness 25 along a top surface of segment 31. Such lines of weakness 25 permit a user to quickly and accurately snap or cut off an excess region of segment 31. Although, the lines of weakness 25 are shown to be curvilinear, any suitable shape can be provided.

The segments 13, 14, 12, 31 may be manufactured from cut resistant plastic or other cut resistant material well know in the art. The term cut resistant is intended to define materials that can withstand repeated external forces from a knife blade or other sharp object. Of course, segment 31 may be perforated in the manner noted above to permit removal of excess portions.

In a non-limiting example, the culinary finger guard 10 would be simple and straightforward to use. First, the user may slip the finger guard 10 onto his forefinger such that the first segment 13 may be positioned on the medial section 20 of his/her forefinger with the ring holder 11 gripping the middle phalange 29 of the forefinger. End segment 31 may be positioned at a distal or terminal end 26 of the forefinger. The finger guard 10 may next be adjustably positioned on the forefinger to ensure that all the segments 13, 14, 12, 31 are comfortably and flexibly fitted about the forefinger. With the guard 10 in place, the user may position the knife to cut or slice food downwardly towards the distal end of the forefinger and thereby ensuring the knife glides over the leading and trailing 16, 17 edges of compound segment 31.

In an alternative embodiment, the compound segments 12 may be positioned between the first segment 13 and middle segment 14 or between the middle segment 14 and end segment 31. In this way, the finger guard 10 may provide users with an alternate arrangement of the segments 13, 14, 12, 31 to ensure comfort and fit.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A finger guard for protecting a user finger from being cut by a cutting implement while preparing food, said finger guard comprising:

a first segment;

a plurality of compound segments spaced from said first segment;

a middle segment intermediately disposed between said first and compound segments respectively;

an end segment positioned at a distal end of said compound segments;

wherein the first segment, middle segment, plurality of compound segments and end segment each have an entire longitudinal length and wherein the entire longitudinal length of at least the first segment is longer than the entire longitudinal length of any one of the plurality of compound segments; and an underlayment attached to each of said first, middle, compound and end segments respectively; wherein said underlayment and each of said first, middle, compound and end segments are pivotally connected to one another and are independently displaced along mutually exclusive paths when said underlayment is displaced;

wherein said underlayment is designed to cover a major surface area of a bottom surface of each said first, middle, compound and end segments and the bottom surface is adapted to contact the user's finger when the finger guard is being used.

2. The finger guard of claim 1, further comprising:

a first obliquely angled gap located between adjoining edges of said first and middle segments respectively;

a second obliquely angled gap located between adjoining edges of said middle segment and an adjacent one of said compound segments respectively; and a plurality of third obliquely angled gaps located between adjoining edges of remaining ones of said compound segments respectively.

3. The finger guard of claim 1, wherein said first segment has a leading edge and a trailing edge, said leading edge having a thickness greater than a thickness of said trailing edge.

4. The finger guard of claim 1, wherein said middle segment comprises:

an adjustable holder adapted to receive the user finger in such a manner that said middle segment is capable of lying medially between first and second knuckles of the user finger.

5. The finger guard of claim 3, wherein said middle segment has trailing edge provided with a thickness greater than said thickness of said leading edge of said first segment;

wherein said thickness of said trailing edge of said middle segment is uniform along an entire longitudinal edge of said middle segment.

6. The finger guard of claim 1, wherein said middle segment is pivotal relative to said first segment and said compound segments respectively.

7. The finger guard of claim 1, wherein first and middle segments are substantially linear, wherein said compound segments are formed to be deformably resilient and thereby selectively biased between curvilinear and linear positions respectively.

8. The finger guard of claim 1, when said first and middle segments as well as said compound segments are axially aligned along a linear path when the user finger is adapted to linear position.

9. The finger guard of claim 1, wherein selected ones of said compound segments comprise: a leading edge and a trailing edge respectively, wherein said leading edge is thicker than said trailing edge, wherein said trailing edge overlaps a juxtaposed one of said leading edge such that said leading edge extends beyond said juxtaposed trailing edge.

10. The finger guard of claim 1, further comprising:

a plurality of first obliquely angled grooves formed at opposed longitudinal edges of said first and middle segments respectively; and a plurality of second obliquely angled grooves formed at opposed longitudinal edges of selected ones of said compound segments respectively.

11. The finger guard of claim 1, wherein said compound segments are configured along a curvilinear path when said underlayment is at a non-tensioned equilibrium position.

12. The finger guard of claim 1, wherein said underlayment is formed from deformably resilient material, said underlayment returning to a non-tensioned curvilinear position after being released from a tensioned linear position.

13. The finger guard of claim 1, wherein said end segment is provided with a plurality of perforations defining lines of weakness.

14. A finger guard for protecting a user finger from being cut by a cutting implement while preparing food, said finger guard comprising:

a first segment;

a plurality of compound segments spaced from said first segment;

a middle segment intermediately disposed between said first and compound segments respectively;

an end segment positioned at a distal end of said compound segments;

wherein the first segment, middle segment, plurality of compound segments and end segment each have an entire longitudinal length and wherein the entire longitudinal length of at least the first segment is longer than the entire longitudinal length of any one of the plurality of compound segments; and an underlayment attached to each of said first, middle, compound and end segments respectively; wherein said underlayment and each of said first, middle, compound and end segments are pivotally connected to one another and are independently displaced along mutually exclusive paths when said underlayment is displaced;

wherein said underlayment is designed to cover a major surface area of a bottom surface of each said first, middle, compound and end segments and the bottom surface is adapted to contact the user's finger when the finger guard is being used;

wherein said first segment is pivotally coupled directly to said middle segment; wherein said middle segment is pivotally coupled directly to a proximal one of said compound segments;

wherein said end segment is pivotally coupled directly to a distal one of said compound segments.

15. The finger guard of claim 14, further comprising:

a first obliquely angled gap located between adjoining edges of said first and middle segments respectively;

a second obliquely angled gap located between adjoining edges of said middle segment and an adjacent one of said compound segments respectively; and a plurality of third obliquely angled gaps located between adjoining edges of remaining ones of said compound segments respectively.

16. The finger guard of claim 14, wherein selected ones of said compound segments comprise: a leading edge and a trailing edge respectively, wherein said leading edge is thicker than said trailing edge, wherein said trailing edge overlaps a juxtaposed one of said leading edge such that said leading edge extends beyond said juxtaposed trailing edge.

17. The finger guard of claim 14, further comprising:

a plurality of first obliquely angled grooves formed at opposed longitudinal edges of said first and middle segments respectively; and a plurality of second obliquely angled grooves formed at opposed longitudinal edges of selected ones of said compound segments respectively.

18. The finger guard of claim 14, wherein said compound segments are configured along a curvilinear path when said underlayment is at a non-tensioned equilibrium position.

19. The finger guard of claim 14, wherein said underlayment is formed from deformably resilient material, said underlayment returning to a non-tensioned curvilinear position after being released from a tensioned linear position.

20. A finger guard for protecting a user finger from being cut by a cutting implement while preparing food, said finger guard comprising:

a first segment;

a plurality of compound segments spaced from said first segment;

a middle segment intermediately disposed between said first and compound segments respectively;

an end segment positioned at a distal end of said compound segments;

wherein the first segment, middle segment, plurality of compound segments and end segment each have an entire longitudinal length and wherein the entire longitudinal length of at least the first segment is longer than the entire longitudinal length of any one of the plurality of compound segments; and an underlayment attached to each of said first, middle, compound and end segments respectively; wherein said underlayment and each of said first, middle, compound and end segments are pivotally connected to one another and are independently displaced along mutually exclusive paths when said underlayment is displaced;

wherein said underlayment is designed to cover a major surface area of a bottom surface of each said first, middle, compound and end segments and the bottom surface is adapted to contact the user's finger when the finger guard is being used;

wherein an entire longitudinal length of said finger guard equal a sum of the entire longitudinal length of said first segment, the entire longitudinal length of each said compound segments, the entire longitudinal length of said middle segment, and the entire longitudinal length of said end segment;

wherein said first segment is pivotally coupled directly to said middle segment;

wherein said middle segment is pivotally coupled directly to a proximal one of said compound segments;

wherein said end segment is pivotally coupled directly to a distal one of said compound segments.

* * * * *